United States Patent [19]

Barsimanto et al.

[11] Patent Number: 4,954,750

[45] Date of Patent: Sep. 4, 1990

[54] FLEXIBLE ION EMITTER

[76] Inventors: Albert Barsimanto, 2242 Paradise Dr., Tiburon, Calif. 94920; Maris Ambats, 77 Bleecker St., Apt. 533, New York, N.Y. 10012

[21] Appl. No.: 216,096

[22] Filed: Jul. 7, 1988

[51] Int. Cl.[5] ..... H01J 27/02

[52] U.S. Cl. ..... 315/111.81; 315/111.91; 313/230; 313/362.1

[58] Field of Search ..... 315/111.81, 111.91; 313/230, 362.1

[56] References Cited

U.S. PATENT DOCUMENTS

| | | | |
|---|---|---|---|
| 3,054,553 | 9/1962 | White | 315/111.91 |
| 4,634,057 | 1/1987 | Coffee et al. | 315/111.81 X |
| 4,638,210 | 1/1987 | Jergenson | 315/111.81 X |
| 4,801,849 | 1/1989 | Slodzian et al. | 315/111.81 |
| 4,803,503 | 2/1989 | Mayer | 315/111.81 X |
| 4,812,711 | 3/1989 | Török et al. | 315/111.91 |

*Primary Examiner*—Eugene R. Laroche
*Assistant Examiner*—Do H. Yoo
*Attorney, Agent, or Firm*—Melvin R. Stidham

[57] ABSTRACT

An air ion emitter has a needle-like emitter coaxially mounted within a cylindrical barrel. The barrel is pivoted and rotatable on the base so that it can be pointed in any direction and angle, as at a collector at opposite plurality. The end of the barrel has venturi slots therein so that air flow induced by the emission of ions is radially inward and then axially out the end to scour the needle point and keep it sharp.

8 Claims, 1 Drawing Sheet

FLEXIBLE ION EMITTER

BACKGROUND OF THE INVENTION

Impurities in the air, including tobacco smoke, bacteria, formaldehyde and radon, all have a deleterious effect on the comfort and health of persons breathing such air, particularly in an indoor environment. Previous efforts to remove smoke and impurities from the air have included the provision of filter systems and electrostatic precipitators. Filter systems include fans that are generally rather noisy and, particularly as tars and other impurities accumulate on the blades, tend to vibrate and intensify the noise factor. In addition, since the filters used in such systems have to allow for free passage of air, they do not block out and remove more than a small fraction of the sub-micron particles carried in the air, and such minute particles constitute the more damaging components of the air being inhaled. Moreover, to the extent that such filters do effect the collection of cigarette tars and other particles, they tend to become malodorous, and require periodic cleaning and/or replacement.

Similarly, electrostatic precipitators require substantial power for both the fan and the ionizing electrodes and the collector plates require periodic cleaning.

The present inventors previously developed an ashtray wherein the cigarette or cigar is made to act as one of the ionizing electrodes so that the smoke is ionized as it is produced and deposits on a collector, which is oppositely charged. The ashtray includes, as a separate optional feature, an air ionizing electrode which simply emits free air ions to the surrounding atmosphere, whereby ambient smoke and other impurities in the atmosphere are charged to precipitate on the collector or any other nearby surface at ground potential. There is no provision for "aiming" such electrode or adjusting the distance between electrode and collector.

OBJECTS OF THE INVENTION

It is an object of this invention to provide an air ionizing electrode that can be directionally oriented.

It is a further object of this invention to provide an air ionizing electrode which may be directed toward a particular area of the room.

It is a further object of this invention to provide a needle electrode which is maintained in sharp polished condition by movement of the air induced thereby.

It is a further object of the invention to provide an air ionizing emitter wherein the spacing between emitter and collector can be adjusted.

Other objects and advantages of this invention will become apparent from the description to follow, particularly when read in conjunction with the accompanying drawing.

SUMMARY OF THE INVENTION

In carrying out this invention, we provide a needle electrode which is coaxially disposed within a circular, tubular barrel. A high voltage negative charge is applied to the needle so that a stream of ions is projected from the barrel. The barrel is pivotally mounted on a support member so that the angle of trajectory of the ion stream can be controlled, and the support member itself is rotatable on a base so that the "ion gun" can be disposed at a selected angle about the vertical axis, as well as at a selected angle with the horizon. Thus, the ion emitter can be pointed in a selected zone of a room or at a selected collector item to which is applied a positive voltage or is at ground potential. Where the opposite voltage is applied to the collector the rotation or tilting of the electrode toward the collector tends to neutralize the ion stream to some extent so that the strength of the charge can be controlled.

DESCRIPTION OF A PREFERRED EMBODIMENT

Figures 1, 2:
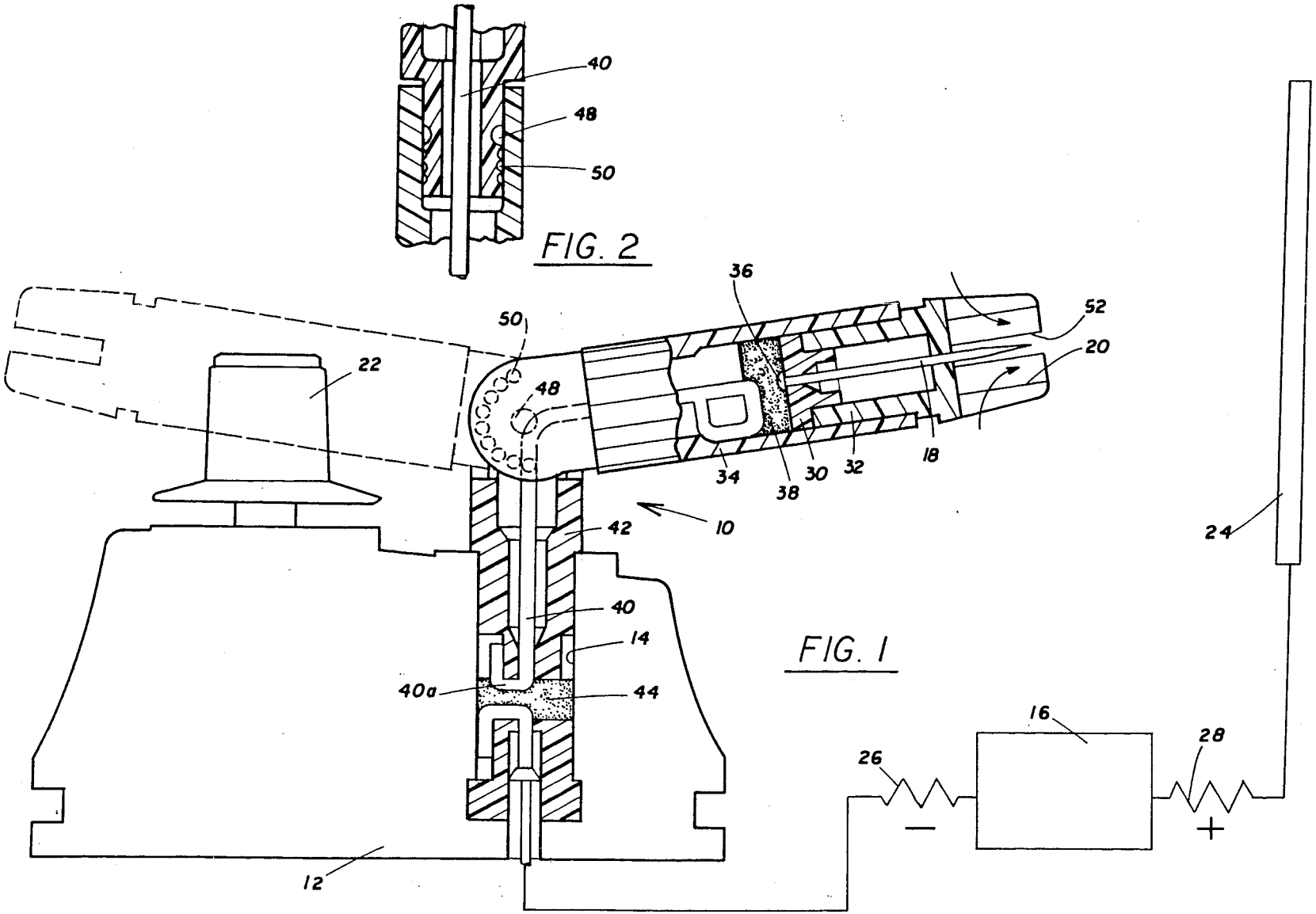
FIG. 1 is an elevation view partially in section of the flexible ion emitter of this invention with diagrammatic representation of significant components.
FIG. 2 is a partial section view showing the flexible joint between ion emitter and support member.

Referring now to the drawing with greater particularity, the electrostatic air purifier 10 of this invention includes a base 12 with an electric socket 14. A power supply 16 may be contained within the base 12 to deliver a high negative voltage, low amperage current to a needle-like electrode 18, which is coaxially disposed within a barrel 20 to project a stream of ions out the end of the barrel 20. A rheostat control, shown generally at 22, may be provided to adjust the voltage level. A collector 24 is preferably connected to a potential of opposite polarity to that of electrode 18, but it is to be understood that any suitable object, which is connected to ground may function as the collector.

We have found that a voltage differential in a range of 5,000 volts to 30,000 volts may be employed but, preferably, the electrode 18 is charged with a negative potential of approximately 15,000 volts and the collector 24 is charged to the opposite, positive potential of approximately 15,000 volts. Resistors 26 and 28, which may be incorporated into the power supply 16, limit the output current to the range of one to ten microamperes, constituting a total power requirement at a very low level that is not hazardous and virtually shock proof.

The electrode needle 18 is centered coaxially within the barrel 20 by means of a cap 30 carried on the cartridge 32. When the cartridge 32 is inserted into the support member 34, a head 36 on the needle electrode comes into firm contact with an electrically conductive foam 38, which has high electrical resistance properties to reduce the tendency for the high voltage to build up charges on nearby capacitance. A flexible insulated conductor 40 extends through the support member 34 and plug 42 to form a terminal **40*a*. When the plug 42 is inserted into socket 14, the terminal 40*a* contacts another conductive foam 44**.

High voltage from the power supply 16 is delivered through conductor 46 to the conductive foam 44 in the socket 14. When the plug 42 is inserted into the socket 14, it is retained by friction grip and it can be rotated within the socket 14, through virtually 360° and set to a selected position. The support member 34 is pivoted at 48 to the plug 42 and a series of detents 50 allows the support member to be ratcheted into position in any selected inclination from approximately horizontal to vertical. Hence, the barrel may be tilted to a selected angle, and the barrel and base plug member 42 rotated as a unit to point in any selected direction as, for example, pointed at the collector 24. Also as seen in FIG. 1, the more the barrel 20 is tilted toward the collector 24, it brings the electrode emitter 18 closer to the positively charged collector 24 so that the positive and negative ions emitting from the collector and electrode, respectively, tend to neutralize each other and weaken the field between them. Hence, the operator has a finely tuned control over the voltage differential between electrode 18 and collector 24.

As shown in FIG. 1, the electrode 18 is completely contained within the barrel 20, and a series of narrow slots 52 are formed in the distal end of the barrel to constitute flow-restricting venturis. As ions are emitted from the electrode 18, it induces a flow of air radially inward through the venturi slots 52, whereby the air then flows axially outward at a rapid rate in the direction of the arrows. This flow of air across the needle 18 tends to scrub the needle to keep it sharp and shining to increase the life thereof. The electrode tends to oxidize in time and the air flow so induced moves with enough force to scour the metal of the coaxially disposed needle and keep it sharp.

While this invention has been described in conjunction with a preferred embodiment thereof, it is obvious that modifications and changes therein may be made by those skilled in the art to which is pertains, without departing from the spirit and scope of this invention, as defined by the claims appended hereto.

What is claimed as invention is:

1. A flexible ion emitter comprising:

a tubular barrel having an open discharge end;

a pointed electrode needle mounted along the axis of said barrel centrally spaced and contained entirely therein with the point thereof near said open end;

a support member;

an ion collector mounted in lateral spaced relation to the other end of said barrel;

said other end being pivotally mounted on said support member so that said barrel may be aimed at a selected angle to said ion collector;

means applying a voltage differential in excess of 5,000 volts to said electrode and said collector so that said electrode will project a stream of ions out said open end of said barrel to said collector.

2. The flexible ion emitter defined by claim 1 including:

a base;

said support member being rotatably mounted on said base.

3. The flexible ion emitter defined by claim 1 including:

a series of slots spaced around said open end of said barrel forming venturi restrictions for air flow radially inward therethrough to impinge upon said needle and scour same and then flow axially outward through said open end of said barrel.

4. The flexible ion emitter defined by claim 1 wherein said voltage applying means comprises:

a power supply delivering to said electrode a negative potential in excess of 10,000 volts.

5. An ion emitter comprising:

a tubular barrel having an open discharge end;

a pointed electrode needle spaced within said barrel along the axis thereof and contained entirely therein with the point of said needle near said open end;

a support member;

said barrel being mounted at its other end on said support member;

an ion collector mounted in spaced relation to said barrel;

means applying a voltage differential in excess of 10,000 volts to said electrode and said collector so that said electrode will project a stream of ions out said open end of said barrel to said collector; and means forming a series of slots spaced around said barrel at said open end forming venturi restrictions for air flow radially inward therethrough to impinge upon and scour said point of the needle and then flow axially outwardly through said open end of said barrel.

6. The ion emitter defined by claim 5 wherein said voltage applying means comprises:

a power supply delivering to said electrode a negative potential in excess of 12,000 volts.

7. An ion emitter comprising:

a support member;

a tubular barrel open at one end;

an electrical delivery conductor in said support member;

an electrode needle mounted coaxially in said barrel to emit ions from said open end;

complementary coupling means for removably attaching said barrel to said support member; and high resistance, electrically conductive foam in said coupling means in electrical contact with said conductor, and to contact said needle when said barrel is attached to said support member.

8. The ion emitter defined by claim 7 including:

a base;

a socket in said base to receive said support member;

a power supply conductor in said base terminating in said socket;

a quantity of high resistance, electrically conductive foam in said socket in contact with said power supply conductor to be contacted by said delivery conductor when said support member is received in said socket.

* * * * *